United States Patent [19]

Gevers

[11] 4,035,944

[45] July 19, 1977

[54] GUN BARRELS

[75] Inventor: Georges A. Gevers, Liege, Belgium

[73] Assignee: Fabrique Nationale Herstal S.A. en abrege FN, Herstal, Belgium

[21] Appl. No.: 702,507

[22] Filed: July 6, 1976

[30] Foreign Application Priority Data

Sept. 26, 1975 Belgium ..... 254586

[51] Int. Cl.[2] ..... F41C 27/00

[52] U.S. Cl. ..... 42/75 B

[58] Field of Search ..... 42/75 B, 75 A, 76 R

[56] References Cited

U.S. PATENT DOCUMENTS

| | | | |
|---|---|---|---|
| 816,015 | 3/1906 | Johnson | 42/75 B |
| 1,856,395 | 5/1932 | Loomis | 42/75 B |
| 2,402,086 | 6/1946 | Rix | 42/75 B |

*Primary Examiner*—Charles T. Jordan

*Attorney, Agent, or Firm*—Bacon & Thomas

[57] ABSTRACT

The invention pertains to an improvement to gun barrels of the type provided with a fixing and guiding ring having a base which is brazed or welded on to the barrel, wherein the aforesaid base has, on at least one of its transverse faces (with respect to the axis of the barrel), a groove or chink near said base.

5 Claims, 5 Drawing Figures

GUN BARRELS

The present invention relates to an improvement to gun barrels, more specifically to barrels provided, in their lower forward part, with a fixing and guiding ring intended, e.g., to be used around a magazine tube. In a general way of speaking the barrels of the aforesaid type are wholly made from a forged steel rough shape provided with an excrescence intended to become the aforesaid fixing ring. It is clear that this conventional manufacturing technique is very expensive.

It has been proposed to make the fixing and guiding ring as a separate part intended for being either welded or brazed on the barrel at a later stage. Weapons which are to be equipped with such barrels show, however, a morphology which is such that restraining dimensional conditions prevent making the base of the ring so that it may have with the barrel a contact area sufficiently large for, on the one hand, satisfactorily brazing and, on the other hand, achieving between the barrel surface and ring body junctions allowing to prevent corrugations of the barrel when shooting.

It has been proposed, indeed, to weld-on rings provided with a base the front face of which lies substantially in the plane of the front face of the ring, whilst the rear part extends in the shape of a footlike resting bracket. With such components systematic corrugations of the barrels have been observed, which make this provision unacceptable.

After a lot of research work, the Applicants have found that the problem described above could be perfectly solved through providing for a ring extended by a fixing base one face of which, at least, being substantially coplanar with a face of the aforesaid ring, is provided with a groove or space hollowed out and located quite near to the resting surface of the said base.

It has been observed that the presence of this groove introduces in the brazed-on component an elasticity sufficient to absorb the strains which, otherwise, would result in corrugation of the barrel.

For clearness sake, a more detailed description of the invention will be made with reference to the attached drawings, in which.

Figure 1:
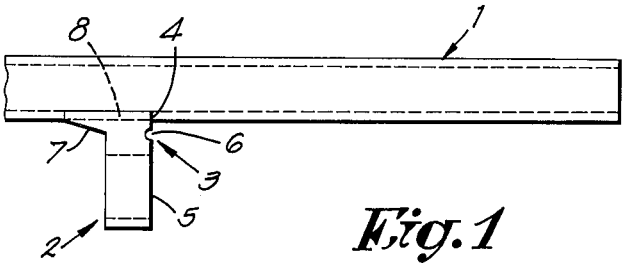
FIG. 1 is a side view of the forward part of a gun barrel provided with a ring according to the invention.

As may be seen in the drawings, the barrel 1 has a fixing ring 2 welded on the said barrel.

Figure 2:
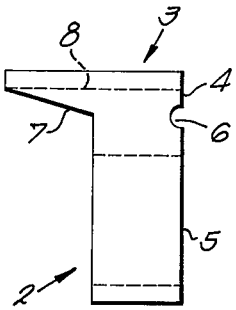
FIGS. 2 and 3 show on a large scale a side view and front view respectively of the ring shown on FIG. 1.

The ring 2 has a base 3, on face 4 of which, at least, is substantially coplanar with the corresponding face 5 of the ring 2 and provided with a space hollowed out, respectively a groove 6. In the embodiment shown on FIGS. 1 through 3, the part 7 of the base 3, looking away from the aforesaid face 4, is shaped so as to obtain a wide resting area 8.

Figure 4:
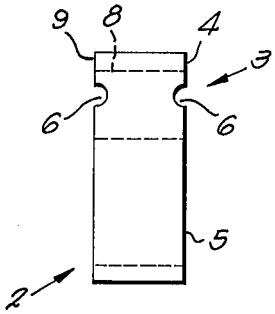
FIG. 4 shows an embodiment which is a variant of the ring according to the invention.

In the example of FIG. 4, the base 3 has two faces 4 and 9 looking away from each other, which are substantially coplanar with the faces of the ring 2, and is provided with two grooves 6.

Figure 3:
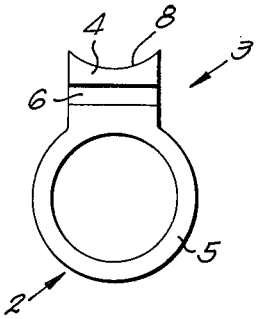
Figure 5:
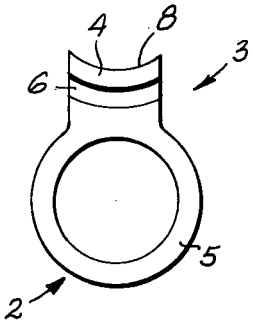
FIG. 5 shows a ring according to FIG. 3 with a curved groove.

The groove or grooves 6 may be either straight, as shown in FIG. 3, or curved as shown in FIG. 5, in which case they are concentric with the wall of the barrel intended to receive the ring. The distance between the upper edge of a groove and resting surface 8 of the base is preferably less than the gun-barrel wall-thickness.

It is clear that modifications can be made to the embodiments described above by way of examples, amongst others according to the kind of barrel and morphology of the weapon to be produced, without going outside the scope of the invention.

What I claim is:

1. In gun barrels of the type provided with a fixing and guiding ring having a base which is secured to the barrel by welding or brazing and having a surface transverse to said barrel, the improvement comprising:

a groove extending transversely of said surface and said barrel, closely adjacent said barrel.

2. The improvement as defined in claim 1 wherein a said groove is provided on each of two opposite surfaces of said ring.

3. The improvement defined in claim 2 wherein the upper edges of said grooves are located at a distance from said barrel no greater than the thickness of the wall of said barrel.

4. The improvement defined in claim 1 wherein said groove is straight.

5. The improvement defined in claim 1 wherein said groove is curved and concentric to the barrel wall.

* * * * *